United States Patent [19]

Hanada et al.

[11] Patent Number: 4,483,537

[45] Date of Patent: Nov. 20, 1984

[54] GOLF BALL

[75] Inventors: Hiroyoshi Hanada, Fuchu; Hiroyoshi Adachi, Fukuyama, both of Japan

[73] Assignee: Hayakawa Rubber Co., Ltd., Fukuyama, Japan

[21] Appl. No.: 391,711

[22] Filed: Jun. 24, 1982

[30] Foreign Application Priority Data

Jan. 6, 1982 [JP] Japan ..... 57-394

[51] Int. Cl.[3] ..... A63B 37/12

[52] U.S. Cl. ..... 273/220; 273/235 R; 273/218; 524/432; 524/908

[58] Field of Search ..... 273/218, 235 R, 220; 524/908, 432, 849, 881, 533, 535

[56] References Cited

U.S. PATENT DOCUMENTS

| | | | |
|---|---|---|---|
| 3,940,146 | 2/1976 | Little | 273/235 R |
| 4,141,559 | 2/1979 | Melvin et al. | 273/235 R |
| 4,165,877 | 8/1979 | Miller et al. | 273/218 |
| 4,185,831 | 1/1980 | Tominaga et al. | 273/235 R |
| 4,266,772 | 5/1981 | Martin et al. | 273/218 |

*Primary Examiner*—Allan M. Lieberman
*Attorney, Agent, or Firm*—Parkhurst & Oliff

[57] ABSTRACT

The disclosed golf ball has a thermally cross-linked solid core with a diameter of 36.5–39.0 mm and a 1.8–2.3 mm thick shell covering the core, in which the composition of the core contains polybutadiene rubber, acrylic or methacrylic acid, an acrylic or methacrylic ester, and an organic peroxide, while the composition of the shell contains an ionomer resin, a metallic acrylate or methacrylate, and a coloring matter.

6 Claims, No Drawings

GOLF BALL

BACKGROUND OF THE INVENTION

1. Field of the Invention

This invention relates to a two-piece golf ball having an excellent striking feel, outstanding flying characteristics and high durability.

2. Description of the Prior Art

Conventional golf balls made by winding resilient thread have a high resilience and an excellent striking feel, but the wound balls have a serious drawback in that their durability is low.

To overcome the low durability of the wound balls, it has been proposed to use two-piece golf balls having a solid core formed by shaping a highly resilient composition into a unitary body and a cut-resisting resin layer covering the solid core. However, the proposed two-piece golf ball failed to provide the characteristics required for tournament use; namely, the proposed two-piece golf ball did not provide resilience as high as expected and did not give either a good striking feel or a good sound when struck by a golf club.

SUMMARY OF THE INVENTION

Therefore, an object of the present invention is to obviate the above-mentioned drawbacks of the prior art by providing an improved two-piece golf ball that has an outstanding durability and yet maintains the excellent striking feel and high resilience equivalent to those of wound balls.

To fulfil the object, a two-piece golf ball according to the present invention comprises a solid core with a diameter of 36.5–39.0 mm formed of a thermally cross-linked composition essentially consisting of 100 parts by weight of polybutadiene rubber with at least 90% of cis-1,4 bonds, 15–25 parts by weight of an acid selected from the group consisting of acrylic acid and methacrylic acid, 1–15 parts by weight of an ester selected from the group consisting of acrylic esters and methacrylic esters, 20–70 parts by weight of zinc oxide, and 1–6 parts by weight of an organic peroxide; and a shell with a thickness of 1.8–2.3 mm covering said solid core, said shell being made of a composition essentially consisting of 100 parts by weight of an ionomer resin, 0.5–10 parts by weight of a metallic salt selected from the group consisting of metallic acrylates and metallic methacrylates, and 1–5 parts by weight of a colouring matter.

The two-piece golf ball of the invention made by covering a specific solid core with a specific shell as defined above has been found to be an excellent two-piece golf ball having higher durability than that of the conventional wound ball while providing better flying characteristics and better striking feel than those of a conventional solid golf ball.

DESCRIPTION OF THE PREFERRED EMBODIMENTS

Polybutadiene rubber to be used in the solid core according to the present invention must contain at least 90%, more preferably at least 95%, of cis-1,4 bonds. When the content of the cis-1,4 bonds is less than 90%, the resilience of the solid core is low and the flying characteristics of the resultant golf ball become inferior, so that a content of cis-1,4 bonds of less than 90% is not desirable.

Acrylic acid or methacrylic acid forms a major portion of the cross-linking monomers for the above-mentioned polybutadiene rubber and acts as a cross-linking agent which reacts with zinc oxide. Methacrylic acid is more preferable than acrylic acid for the cross-linking monomers. The concentration of the acrylic acid or methacrylic acid is 15–25 parts by weight, more preferably 18–24 parts by weight, for 100 parts by weight of the polybutadiene rubber.

An acrylic ester or methacrylic ester is another ingredient of the solid core and acts on the polybutadiene rubber as a cross-linking agent therefor. The ester to be used in the present invention is an ester of acrylic acid or methacrylic acid with an alcohol having two to four hydroxyl groups; more particularly, the ester is preferably ethylene dimethacrylate, 1,3-butylene dimethacrylate, 1,4-butylene dimethacrylate, trimethylolpropane triacrylate, trimethylolpropane trimethacrylate or pentaerythritol triacrylate, of which trimethylolpropane trimethacrylate is particularly preferable.

The above-mentioned ester is added at a rate of 1–15 parts by weight, preferably 3–10 parts by weight, for 100 parts by weight of polybutadiene rubber. If the ester is not added or if the amount of the ester added is too small, the flying characteristics and the striking feel of the resultant golf ball become inferior. On the other hand, if the ester is added in excess of the above-mentioned rate, the durability of the resultant golf ball becomes inferior without improving the flying characteristics thereof.

Zinc oxide used in the solid core not only reacts with the above-mentioned acrylic acid or methacrylic acid so as to act as a cross-linking agent using metallic ionic bonds, but also functions as a filler for adjusting the weight of the resultant golf ball. It is noted here that, when a golf ball is hit by a golf club, the carry, or the distance from where the ball is hit to where the ball first strikes the ground, increases as the golf ball becomes heavier, provided that the initial velocity of the golf ball is constant.

To produce a golf ball weighing 44.5-45.9 grams, which is close to the official maximum weight of 45.92 grams, 20–70 parts by weight of zinc oxide is necessary for 100 parts by weight of the polybutadiene rubber. To produce the so-called small golf ball with the official minimum diameter of 41.15 mm, 45–65 parts by weight of zinc oxide is preferable for 100 parts by weight of polybutadiene rubber, while to produce the so-called large golf ball with the official minimum diameter of 42.67 mm, 25–35 parts by weight of zinc oxide is preferable for 100 parts by weight of the polybutadiene rubber.

As far as the function of the filler for the weight adjustment is concerned, a part of the above-mentioned zinc oxide may be replaced with a suitable other metallic compound such as barium sulfate, silica, or the like.

A radical initiator consisting of a peroxide is added into the composition of the solid core in addition to the above-mentioned ingredients thereof, so as to cure the solid core. A preferable example of the peroxide to be used in the present invention is 1,1-di-tertiary-butylperoxy-3,3,5-trimethylcyclohexane. To obtain the desired hardness and resilience, 1–6 parts by weight, preferably 2–4 parts by weight, of the peroxide is used for 100 parts by weight of the polybutadiene rubber.

The above-mentioned ingredients of the composition of the solid core are mixed and kneaded by a regular rubber kneader such as a roll or a Banbury mixer, and a solid core of the desired diameter is formed by compression molding or injection molding by using a suitable metallic die. The diameter of the solid core is selected by considering the thickness of the shell covering the solid core. More particularly, the diameter of the solid core for the small golf ball is 36.5–37.5 mm, preferably 36.8–37.2 mm, while the diameter of the solid core for the large golf ball is 37.8–39.0 mm, preferably 38.1–38.7 mm.

The shell covering the solid core of the present invention is formed of a composition predominantly consisting of an ionomer resin, namely, 100 parts by weight of an ionomer resin, 0.5–10 parts by weight of a metallic acrylate or metallic methacrylate, and 1–5 parts by weight of a colouring matter. The thickness of the shell is 1.8–2.3 mm.

The above-mentioned ionomer resin contains a metallic salt of a copolymer of ethylene and unsaturated carboxylic acid; wherein the unsaturated carboxylic acid is acrylic acid, methacrylic acid, itaconic acid, or the like, while the metal to form the metallic salt with the unsaturated carboxylic acid is sodium, magnesium, zinc, or the like.

The ionomer resin to be used in the present invention is not restricted by the composition of the ethylene and the unsaturated carboxylic acid and the kind of the metallic salt. Nevertheless, the hardness of the ionomer resin is preferably 65–70 in terms of the Shore hardness D.

Examples of the metallic acrylates or metallic methacrylates to be added in the above-mentioned ionomer resin are magnesium acrylate, magnesium methacrylate, calcium acrylate, calcium methacrylate, zinc acrylate, zinc methacrylate, aluminum acrylate and aluminum methacrylate, of which methacrylate of two-valence metals, such as magnesium methacrylate, calcium methacrylate and zinc methacrylate are preferable. To improve the striking feel and the flying characteristics of the golf ball, 0.5–10 parts by weight, preferably 2–8 parts by weight, of the metallic acrylate or metallic methacrylate is added for 100 parts by weight of the ionomer resin.

As regards the colouring matter, a white pigment such as titanium dioxide or zinc oxide is usually used, and other inorganic pigments or organic pigments may also be used.

As a process for covering the solid core with the above-mentioned shell composition, two semispherical shell members representing two halves of one shell of the invention are formed from the shell composition, and the solid core is wrapped by the two halves of the shell, and then the solid core wrapped by the shell is molded under an elevated pressure at about 170° C. for two minutes. Instead, the shell composition may be applied to the solid core by injection molding so as to cover the solid core.

The invention will be explained in further detail now by referring to examples, wherein the "parts" in the compositions mean the "parts by weight".

EXAMPLES 1–3 AND REFERENCES 1–3

The compositions for the solid cores as shown in Table 1 were shaped into solid cores by compression molding while heating at about 155° C. for 20 minutes, so as to form solid cores with a diameter of 37.2 mm. The compositions of shells as shown in Table 1 were applied to the solid cores by injection molding, so as to cover the solid cores and produce small two-piece golf balls with a diameter of 41.2 mm or 41.3 mm. The properties of the golf balls thus prepared, namely, the compression, durability, flying characteristics in terms of carry, and striking feel thereof were measured. The results are shown in Table 1.

TABLE 1

| Composition and properties | | | Examples | | | References | | |
|---|---|---|---|---|---|---|---|---|
| | | | 1 | 2 | 3 | 1 | 2 | 3 |
| Solid core | Polybutadiene rubber(1) | (parts) | 100 | 100 | 100 | 100 | 100 | 100 |
| | Methacrylic acid | (parts) | 15 | 20 | 25 | 5 | 35 | 10 |
| | Methacrylic ester(2) | (parts) | 10 | 5 | 5 | 25 | 0 | 25 |
| | Zinc ozide | (parts) | 60 | 60 | 60 | 60 | 60 | 60 |
| | Organic peroxide(3) | (parts) | 3 | 3 | 3 | 3 | 3 | 3 |
| Shell | Ionomer resin(4) | (parts) | 100 | 100 | 100 | 100 | 100 | 100 |
| | Zinc methacrylate | (parts) | 2 | 2 | 2 | 2 | 2 | 2 |
| | Titanium dioxide | (parts) | 2 | 2 | 2 | 2 | 2 | 2 |
| Properties | Core weight | (g) | 36.0 | 35.6 | 35.8 | 35.2 | 35.9 | 35.4 |
| | Diameter of two-piece golf ball | (mm) | 41.3 | 41.2 | 41.2 | 41.2 | 41.2 | 41.3 |
| | Shell thickness | (mm) | 2.1 | 2.0 | 2.0 | 2.0 | 2.1 | 2.1 |
| | Weight of two-piece golf ball | (g) | 45.3 | 45.0 | 45.2 | 45.1 | 45.3 | 45.2 |
| | Compression(5) | | Good | Good | Good | Rather soft | Too hard | Good |
| | Durability(6) | | Excellent | Excellent | Excellent | Poor | Excellent | Fair |
| | Carry(7) | (m) | 210 | 220 | 215 | 205 | 200 | 203 |
| | Striking feel | | Excellent | Excellent | Excellent | Soft | Too hard | Fair |

Notes:
(1)Polybutadiene rubber contained 97% of cis-1,4 bonds.
(2)Methacrylic ester was trimethylolpropane trimethacrylate.
(3)Organic peroxide was 1,1-di-tertiary-butylperoxy-3,3,5-trimethylolcyclohexane.
(4)Ionomer resin was Surlyn 1706 (Trademark) made by duPont Co., Ltd. of U.S.A.
(5)Compression was tested by an ACCU compression tester.
(6)Durability was determined based on the number of repetitions of vertical dropping of a 3 kg weight from a height of 1.5 m toward the golf ball.
(7)Carry was the mean values of ten carries when hit by professional golf player with the wood No. 1 golf club (the driver club).

The concentrations of methacrylic acid and methacrylic ester in the Examples 1, 2 and 3 were both within the limits of the present invention, while the concentrations of methacrylic acid and/or methacrylic ester in the References 1, 2 and 3 were outside of the limits of the present invention.

As can be seen from Table 1, the two-piece golf balls according to the present invention had a large carry, a proper compression hardness so as to provide a good striking feel and an excellent durability. On the other hand, the golf ball with an insufficient amount of methacrylic acid, as shown in the Reference 1, was soft, so that the striking feel thereof was inferior and the durability thereof was poor, while the golf ball of the Reference 2 without any methacrylic ester had a small carry and was too soft.

EXAMPLES 4–6 AND REFERENCES 4 AND 5

Compositions for solid cores as shown in Table 2 were shaped into solid cores with a diameter of 38.7 mm through the same method as the above-mentioned Examples 1 through 3. Large two-piece golf balls with a diameter of 42.7 mm or 42.8 mm were prepared by covering the thus shaped solid cores with cells having the compositions as shown in Table 2.

The properties of the large golf balls thus produced were measured in the same manner as those of the Examples 1 through 3. The result is shown in Table 2.

TABLE 2

| Composition and properties | | | Examples 4 | Examples 5 | Examples 6 | References 4 | References 5 |
|---|---|---|---|---|---|---|---|
| Solid core | Polybutadiene rubber(1) | (parts) | 100 | 100 | 100 | 100 | 100 |
| | Methacrylic acid | (parts) | 20 | 20 | 25 | 20 | 20 |
| | Methacrylic ester(2) | (parts) | 5 | 10 | 5 | 10 | 10 |
| | Zinc ozide | (parts) | 30 | 30 | 30 | 30 | 30 |
| | Organic peroxide(3) | (parts) | 6 | 4 | 2 | 8 | 1 |
| Shell | Ionomer resin(4) | (parts) | 100 | 100 | 100 | 100 | 100 |
| | Zinc methacrylate | (parts) | 6 | 6 | 6 | 6 | 6 |
| | Titanium dioxide | (parts) | 3 | 3 | 3 | 3 | 3 |
| Properties | Core weight | (g) | 36.0 | 35.9 | 35.7 | 36.2 | 35.7 |
| | Diameter of two-piece golf ball | (mm) | 42.7 | 42.7 | 42.7 | 42.8 | 42.7 |
| | Shell thickness | (mm) | 2.0 | 2.1 | 2.1 | 2.0 | 2.0 |
| | Weight of two-piece golf ball | (g) | 45.8 | 45.7 | 45.7 | 45.8 | 45.7 |
| | Compression | | Good | Good | Good | Good | Soft |
| | Durability | | Excellent | Excellent | Excellent | Poor | Fair |
| | Carry | (m) | 208 | 209 | 205 | 206 | 200 |
| | Striking feel | | Excellent | Excellent | Excellent | Rather hard | Rather soft |

Notes:
(1)Polybutadiene rubber contained 97% of cis-1,4 bonds.
(2)Methacrylic ester was trimethylolpropane trimethacrylate.
(3)Organic peroxide was 1,1-di-tertiary-butylperoxy-3,3,5-trimethylolcyclohexane.
(4)Ionomer resin was Surlyn 1605 (Trademark) made by duPont Co., Ltd. of U.S.A.

The golf balls of Examples 4, 5 and 6 were made of compositions within the scope of the present invention, including the concentration of the peroxide therein, and they proved to be excellent two-piece golf balls having an outstanding durability, good flying characteristics and an excellent striking feel, as shown in Table 2.

The golf ball of Reference 4 contained the organic peroxide in excess of the composition of the present invention, and had an inferior durability and rather hard striking feel. If the concentration of the organic peroxide was too small as in the case of the Reference 5, the resultant golf ball had an inferior resilience and poor flying characteristics. Thus, it was proved that, if the concentration of the peroxide falls outside the composition of the present invention, two-piece golf balls with satisfactory properties cannot be achieved.

EXAMPLES 7–9 AND REFERENCES 6–8

The golf balls of Table 3 were made by using solid cores which were prepared by using the same material and the same method as those of Example 3, but the diameters of the solid cores of Table 3 were modified from that of Example 3. The shells with the compositions of Table 3 were applied to the above-mentioned solid cores, so that the shells of Table 3 contained different ionomers and had different concentrations of the metallic methacrylate and different thicknesses. The properties of the golf balls thus made were measured, and the results are shown in Table 3.

TABLE 3

| Composition and properties | | | Examples 7 | Examples 8 | Examples 9 | References 6 | References 7 | References 8 |
|---|---|---|---|---|---|---|---|---|
| Shell | Ionomer resin(1) | (parts) | | | | | | |
| | Surlyn 1601 | | | | | | | 100 |
| | Surlyn 1605 | | | | 100 | | | |
| | Surlyn 1706 | | 100 | 100 | | 100 | 100 | |
| | Metallic methacrylate(2) | (parts) | 3 | 7 | 7 | 3 | | 7 |
| | Titanium dioxide | (parts) | 2 | 2 | 2 | 2 | 2 | 2 |
| | Shell thickness | (mm) | 1.8 | 2.2 | 2.0 | 1.6 | 2.0 | 1.6 |
| Properties | Core diameter | (mm) | 37.4 | 37.0 | 37.2 | 37.6 | 37.2 | 37.6 |
| | Core weight | (g) | 36.6 | 36.0 | 36.4 | 36.7 | 36.0 | 36.7 |
| | Diameter of two-piece golf ball | (mm) | 41.2 | 41.3 | 41.2 | 41.2 | 41.2 | 41.2 |
| | Weight of two-piece golf ball | (g) | 45.4 | 45.3 | 45.5 | 45.8 | 45.3 | 45.8 |
| | Compression | | Good | Good | Good | Good | Rather soft | Rather soft |
| | Durability | | Excellent | Excellent | Excellent | Fair | Excellent | Excellent |
| | Carry | (m) | 216 | 221 | 223 | 205 | 208 | 210 |
| | Striking feel | | Excellent | Excellent | Excellent | Fair | Rather | Rather |

TABLE 3-continued

| Composition and properties | Examples | | | References | | |
|---|---|---|---|---|---|---|
| | 7 | 8 | 9 | 6 | 7 | 8 |
| | | | | | soft | soft |

Notes:
(1)Ionomer resin was Surlyn (Trademark) made by duPont Co., Ltd. of U.S.A.
(2)Metallic methacrylate was zinc methacrylate.

The two-piece golf balls of the Examples 7, 8 and 9 had concentrations of the metallic methacrylate and shell thickness both within the scope of the invention, and they proved to be satisfactory two-piece golf balls having satisfactory properties and performances such as proper compression, high durability, excellent striking feel, and outstanding flying characteristics.

However, the golf balls of References 6 and 8 had thin shells, and the flying characteristics and striking feel of such golf balls proved to be unsatisfactory. Reference 7 represented a golf ball which did not contain any metallic methacrylate, and even if a shell of the same thickness as that of the invention was used, the hardness and the flying characteristics of Reference 7 proved to be inferior to that of the invention.

As described in the foregoing, the composition of the solid core and the shell according to the present invention provide an improved two-piece golf ball having an outstanding durability while maintaining the excellent striking feel and high resilience equivalent to those of the conventional wound golf ball.

Although the invention has been described with a certain degree of particularity, it is understood that the present disclosure has been made only by way of example and that numerous changes in details of construction and the ingredients may be resorted to without departing from the scope of the invention as hereinafter claimed.

What is claimed is:

1. A golf ball, comprising a solid core with a diameter of 36.5–39.0 mm formed of a thermally cross-linked composition consisting essentially of 100 parts by weight of polybutadiene rubber with at least 90% of cis-1,4 bonds; 15–25 parts by weight of an acid selected from the group consisting of acrylic acid and methacrylic acid, 1–15 parts by weight of an ester selected from the group consisting of acrylic esters and methacrylic esters, 20–70 parts by weight of zinc oxide, and 2–6 parts by weight of an organic peroxide; and a shell with a thickness of 1.8–2.3 mm covering said solid core, said shell being made of a composition consisting essentially of 100 parts by weight of an ionomer resin which consists essentially of a first metallic salt of a copolymer of ethylene and unsaturated carboxylic acid and which has a hardness of 65–70 in terms of Shore hardness D, 0.5–10 parts by weight of a second metallic salt selected from the group consisting of metallic acrylates and metallic methacrylates, and 1–5 parts by weight of a colouring matter.

2. A golf ball as set forth in claim 1, wherein said ester in the solid core is at least one ester selected from the group consisting of ethylene dimethacrylate, 1,3-butylene dimethacrylate, 1,4-butylene diamethacrylate, trimethylolpropane triacrylate, trimethylolpropane trimethacrylate, and pentaerythritol triacrylate.

3. A golf ball as set forth in claim 1, wherein said organic peroxide is 1,1-di-tertiary-butylperoxy-3,3,5-trimethylcyclohexane.

4. A golf ball as set forth in claim 1, wherein said metallic salt is at least one metallic salt selected from the group consisting of magnesium acrylate, magnesium methacrylate, calcium acrylate, calcium methacrylate, zinc acrylate, zinc methacrylate, aluminum acrylate, and aluminum methacrylate.

5. A golf ball as set forth in claim 1, wherein said composition of the solid core further contains a filler selected from the group consisting of barium sulfate and silica.

6. A golf ball as set forth in claim 1, wherein said colouring matter is selected from the group consisting of titanium dioxide, zinc oxide, inorganic pigments, and organic pigments.

* * * * *